United States Patent [19]

Sturwold

[11] 4,075,393

[45] Feb. 21, 1978

[54] MODIFIED TRIGLYCERIDE METAL WORKING LUBRICANTS

[75] Inventor: Robert J. Sturwold, Cincinnati, Ohio

[73] Assignee: Emery Industries, Inc., Cincinnati, Ohio

[21] Appl. No.: 759,071

[22] Filed: Jan. 13, 1977

Related U.S. Application Data

[62] Division of Ser. No. 627,852, Nov. 3, 1975.

[51] Int. Cl.[2] ..... B32B 15/04; B32B 15/20; C10M 1/06

[52] U.S. Cl. ..... 428/457; 252/49.5; 252/56 R; 260/410.7

[58] Field of Search ..... 428/457; 252/49.5, 56 R; 260/410.7

[56] References Cited

U.S. PATENT DOCUMENTS 3,928,401 12/1975 Sturwold et al. ..... 260/410.7

*Primary Examiner*—J.C. Cannon

*Attorney, Agent, or Firm*—Gerald A. Baracka; John D. Rice

[57] ABSTRACT

Mixed ester products obtained by treatment of a triglyceride under transesterification conditions with a polyoxyalkylene glycol and a high molecular weight dicarboxylic acid, such as polymer acids, are useful metal working fluids. The modified triglycerides exhibit enhanced thermal stability and can be used either in neat form or in solution and are readily compatible with water to provide stable aqueous emulsions and dispersions having superior lubrication properties.

5 Claims, No Drawings

MODIFIED TRIGLYCERIDE METAL WORKING LUBRICANTS

This is a division, of application Ser. No. 627,852, filed Nov. 3, 1975.

BACKGROUND OF THE INVENTION

The modification of triglycerides to obtain mixed ester products useful for lubricating and other applications is known. U.S. Pat. No. 3,202,607 discloses the ethoxylation of castor oil and the use of aqueous dispersions of these adducts as metal working fluids. In British Patent No. 847,517 two mols triglyceride and one mol polyethylene glycol are interesterified to obtain products which are mixtures of mono-, di- and tri-glycerides and mono- and diesters of polyethylene glycol. The reaction of castor oil with a polyoxyalkylene glycol and an organic dicarboxy acid, such as diglycolic acid or phthalic anhydride, is taught by U.S. Pat. No. 2,925,429. These products are employed for resolving water-in-oil emulsions. U.S. Pat. No. 2,971,923 discloses similar products useful for breaking petroleum emulsions and desalting mineral oils.

The ester lubricants disclosed in U.S. Pat. No. 3,720,695 have utility in a wide variety of use areas and are obtained by transesterifying castor oil with polyoxyethylene glycol of molecular weight greater than 1000 and then, in a separate and distinct step, esterifying the available hydroxyl groups with a mono- or dicarboxylic acid. In copending application Serial No. 438,283, now U.S. Pat. No. 3,928,401 significantly improved water soluble mixed ester products have been obtained by reaction of a triglyceride with a short-chain mono- or dicarboxylic acid and a low molecular weight polyoxyethylene glycol in a single-step operation.

SUMMARY OF THE INVENTION

We have now discovered modified triglycerides which are readily emulsifiable with water and useful as metal working lubricants. The products are mixed ester compositions obtained by treatment of a triglyceride under transesterification conditions with a polyoxyalkylene glycol and a high molecular weight dicarboxylic acid. These products can be used neat, in solution with suitable solvents and in aqueous systems as dispersions or emulsions and are useful for both ferrous and non-ferrous metal working operations. The modified triglycerides, in addition to their excellent lubricating and emulsifying properties, also have excellent thermal stability.

It has also most unexpectedly been found that the products of this invention can be used as metal working fluids in operations involving nonferrous metals and metal alloys which are extremely susceptible to staining by lubricants or by oxidation. Even more surprisingly, it has been found that the present modified triglycerides can be advantageously applied in aqueous systems to metals, such as aluminum, which are susceptible to water staining to provide efficient lubrication and, in addition to not staining the metal upon application, they further significantly reduce the susceptibility of the metal to subsequent water staining upon exposure to the atmosphere.

The compositions of this invention are the reaction products obtained by reacting a triglyceride with a polyoxyalkylene glycol and a high molecular weight dicarboxylic acid under transesterification conditions. The commonly known triglycerides can be used, however, triglycerides derived predominantly from $C_{12-18}$ fatty acids are particularly useful. Modified lard oil, tallow, soybean oil, crambe oil, rapeseed oil, castor oil, peanut oil and coconut oil have particular utility as metal working lubricants. Polyoxyalkylene glycols having molecular weights from about 200 to 1,500 can be used, however, best results are obtained with polyethylene glycols having average molecular weights of about 400 to 1,000. The high molecular weight dicarboxylic acid will contain about 18 to 54 and, more preferably 21 to 36, carbon atoms. Dimer acids obtained from the dimerization of olefinically unsaturated $C_{18}$ acids have particular advantage. The modified triglycerides contain 50–84 parts triglyceride, 2–36 parts polyoxyalkylene glycol and 7–48 parts dicarboxylic acid and are further characterized by having an acid value at least 25% less than the acid value of the initial reaction mixture. The modified triglyceride product can be used neat, in solution with a suitable solvent, carrier oil or base oil and as aqueous dispersions or emulsions.

DETAILED DESCRIPTION

The modified triglycerides, also referred to herein as mixed esters, are the reaction products of a triglyceride, a polyoxyalkylene glycol and a high molecular weight dicarboxylic acid. The transesterification reaction is conducted employing conventional procedures and conditions. The mixed ester products have superior lubricating properties and possess additional characteristics which make them suitable for use in metal working operations involving non-ferrous metals and alloys. Such metal working operations include grinding, forging, rolling, diecasting, blanking, stamping, drawing, slitting, trimming, extruding and the like.

To obtain the mixed ester products of this invention commonly known triglycerides can be used. Natural and synthetically produced triglycerides include drying, semi-drying and non-drying vegetable oils, animal oils and animal fats are useful and can be modified in accordance with the invention to provide effective lubricant compositions. Triglycerides of the above types include olive oil, palm oil, almond oil, ground nut oil, apricot kernel oil, palm kernel oil, linseed oil, jojoba oil, castor oil, soybean oil, oiticica oil, tung oil, crambe oil, coconut oil, peanut oil, rapeseed oil, neatsfoot oil, cottonseed oil, safflower oil, fish oil, whale oil, tallow, lard and the like. The oils may be used as such or may be hydrogentated prior to use. A single triglyceride may be employed or a mixture of two or more triglycerides can be used. For example, it may be advantageous if a highly conjugated triglyceride such as tung oil or oiticica oil is used to include a saturated or unconjugated oil. Especially useful triglycerides for the preparation of the mixed ester products of this invention are those derived predominantly from $C_{12}$–$C_{18}$ fatty acids and include lard, tallow, soybean oil, coconut oil, castor oil, rapeseed oil, peanut oil and crambe oil.

The polyoxyalkylene glycols employed for this invention have molecular weights less than 2,000 with recurring alkylene groups containing 2 or 3 carbon atoms. While polyethylene glycols having average molecular weights from about 200 to 1,500 are most commonly used, polypropylene glycols and poly(ethylene-propylene) glycols can also be employed. It is possible to employ polyoxyethylene glycols containing higher or lower molecular weight materials and a broad molecular weight distribution of the polyoxyethylene glycol is not generally detrimental to the lubricant properties, however, appreciable amounts of glycols having molecular weights greater than 1,500 should not be present if optimum results are to be obtained. Best results are obtained with polyoxyethylene glycols having average molecular weights between about 400 and 1,000 and glycols of this type are also commercially available.

High molecular weight dibasic acids used in the preparation of the mixed ester compositions of this invention can be aliphatic or cycloaliphatic hydrocarbon acids containing 18 or more carbon atoms. The acids may be straight-chain or branched with one or more alkyl groups and the carboxyl groups can be located in the terminal positions or randomly throughout the molecule. While the dicarboxylic acids can contain from about 18 to 54 carbon atoms they preferably will be $C_{21-36}$ dicarboxylic acids or mixture thereof. Some monobasic acid formed as a reaction intermediate or the result of incomplete reaction and higher polybasic acid forms may be present, however, the dicarboxylic acid should constitute at least 70% by weight of the acid mix and, more preferably, be greater than 80% by weight.

Dicarboxylic acids used in the modification of the triglycerides can be obtained from any one of several processes known to the industry. The dicarboxylic acids may be obtained by the oxidation of hydrocarbons for example, by ozonolysis of $\alpha,\beta$-unsaturated hydrocarbons or other di- or multi-olefinic materials or they may be obtained from the catalytic oxidation of saturated and/or unsaturated hydrocarbons. Also, suitable dicarboxylic acids can be obtained by oxidation of methyl- or formyl-branched acids such as isostearic acid or formylstearic acid. Carboxystearic acids such as heptadecane-1,8-dicarboxylic acid and heptadecane-1,9-dicarboxylic acid as well as other isomeric acids are produced in this manner. Useful dicarboxylic acids can also be obtained by the addition of acrylic acid or methacrylic acid to a monobasic acid containing conjugated unsaturation (e.g. linoleic acid). When linoleic acid (9,11-octadecadienoic acid) and acrylic acid are reacted a dibasic acid of the formula

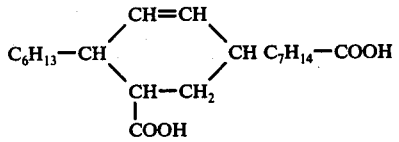

is obtained.

Especially useful for producing dicarboxylic acids utilized in this invention is the polymerization (dimerization) of unsaturated monocarboxylic acids containing from 16 to 26 carbon atoms, such as oleic acid, linoleic acid, ricinoleic acid, linolenic acid and eleostearic acid. Dicarboxylic acids produced in this manner, i.e., when two moles of the unsaturated monocarboxylic acid are combined, are referred to as dimer acids. Processes for producing these dimer acids are well known to the prior art and by way of illustration reference may be had to U.S. Pat. Nos. 2,793,219 and 2,955,121 assigned to Emery Industries, Inc.

Dimer acids obtained from the dimerization of $C_{18}$ acids, such as oleic acid, linoleic acid and mixtures thereof (e.g. tall oil fatty acids), are especially useful and advantageously employed in the preparation of the present modified triglyceride lubricants. Such dimer acids have as their principal component $C_{36}$ dicarboxylic acid and generally have an acid value in the range 180 to 215, saponification value of about 190 to 205 and neutral equivalent of about 265 to 310. Dimer acids containing less than 25 weight percent by-product acids including monobasic acid, trimer acid or higher polymer acids are particularly useful. Dimer acids containing unsaturation can be hydrogenated prior to use if desired.

Just as considerable variation is possible in the selection of the triglyceride, glycol and acid components used in the preparation of the present ester, it is also possible to vary the amount of these reactants. In general 50 to 84 parts of the triglyceride will be reacted with 2 to 36 parts polyoxyethylene glycol and 7 to 48 parts dimer acid. Best results are obtained, however, employing 60 to 76 parts triglyceride, 4 to 20 parts polyoxyethylene glycol and 14 to 36 parts dimer acid, particularly if the modified triglycerides are to be used in aqueous systems. Employing the above reactant charge and conducting the transesterification until at least 25%, and more preferably 50% or more, reduction in acid value is obtained results in extremely useful mixed ester lubricant products.

The transesterification reaction is conducted in accordance with known procedures. While useful products can be obtained by step-wise reaction, the process is more usually and advantageously conducted in a single step. It is customary to charge all the reactants to the reaction vessel and then heat the reaction mixture at a temperature from about 100° C to 300° C but more usually between about 175° C and 275° C. The reaction is maintained at an elevated temperature until the acid value of the initial charge is reduced by at least 25% and, more preferably, reduced 50% or more. To facilitate reaction, water formed during the transesterification is removed using a suitable condenser/trap arrangement. While the use of reduced pressure is not necessary it may be advantageous, especially in the latter stages of the reaction, to pull a vacuum on the system if low acid value products are desired. This facilitates removal of water and drives the reaction. Catalysts are not essential, however, they are usually desirable to speed the rate of reaction. The amount and type of catalyst can be widely varied and any of the known catalysts such as tetrabutyl titanate, zinc acetate, sodium carbonate, sodium sulfate, stannous oxalate, p-toluene sulfonic acid, methane sulfonic acid, sulfuric acid, phosphoric acid and the like may be used. The amount of catalyst will generally range between about 0.01 and 1% by weight and more usually between about 0.03 and 0.5% of the reactant charge. A diluent or solvent which is inert to the reaction conditions and preferably capable of forming an azeotrope with water to facilitate removal of the water from the reaction mixture, such as toluene or xylene, can be employed when conducting the reaction but is not necessary.

It is evident that considerable variation in the compositional makeup of the mixed ester products is possible depending on the reactants used, ratio of the reactants, reaction conditions and extent of reaction. The physical form of the resulting lubricant products can therefore also vary from low viscosity liquids to semi-solid masses. In all events, however, the modified triglycerides are compatible with water and are readily dispersible or emulsifiable therewith even though for the more viscous or semi-solid compositions it may be necessary to heat or melt the mixed ester before combining with water or to heat the mixture with vigorous agitation. The mixed esters typically have flash and fire points greater than 500° F and 575° F, respectively with a 210° F viscosity greater than 10 centistokes.

The mixed ester products are excellent lubricants for both ferrous and non-ferrous metals and can be used in a wide variety of lubricating applications. Because of their ready compatibility with water and non-staining characteristics they find particular utility in metal working operations involving non-ferrous metals where in addition to lubrication a high degree of cooling is desired and staining is an ever present problem. Aqueous lubricant systems, including dispersions and emulsions, containing the modified triglycerides are useful in forging, rolling, casting, cutting, grinding, stamping, extruding, drawing and other metal working operations. The aqueous lubricants are capable of providing a high degree of cooling while also providing a continuous uniform lubricant film on the surface of the metal or between the working parts and the metal. With aqueous dispersion or emulsions the concentration of the modified triglyceride in water will range from about 0.1 to about 25% by weight and, more preferably, from about 1 to 10% by weight.

The present lubricant ester may also be used as neat oils or they may be blended with a suitable solvent, carrier or base oil which in addition to serving as a diluent they can also impart desirable properties to the lubricant formulation. Typically, hydrocarbon oils synthetically produced or obtained from the distillation of crude oil are used for this purpose. Hydrocarbon oils having 100° F viscosities up to about 500 SUS and including such oils as mineral oil and mineral seal oil, kerosene, gas oil and the like are employed for this purpose. The present products may also be formulated with other additives such as stabilizers, fungicides, bacteriocides corrosion inhibitors, wetting agents and the like to enhance their performance in the widely diverse application areas where they find utility.

The present mixed ester lubricants are especially useful with non-ferrous metals and particularly those metals and metal alloys which are susceptible to lubricant and oxidative staining such as aluminum, copper, titanium and magnesium and their alloys. Aluminum and aluminum alloys containing copper, silicon, magnesium, zinc, lithium, beryllium, and the like derive particular benefit from the modified triglycerides of this invention. It has quite unexpectedly been found that by the use of the modified triglycerides it is possible to minimize and in many cases completely eliminate the formation of undesirable lubricant stains on the surface of the aforementioned metals. Furthermore, in the treatment of aluminum and aluminum alloys it is totally unexpected that these lubricants can be applied to the metal in an aqueous medium without the development of water stains on the surface of the metal. It is also possible to provide a protective hydrophobic coating on the surface of these metals, particularly aluminum metal, which is resistant to the formation of water staining and other similar forms of oxidative attack upon exposure to atmospheric conditions during shipment, storage, etc.

The non-staining ability of these lubricants and aqueous formulations thereof make them particularly useful as lubricant/coolants (rolling oils) for both the hot and cold rolling of aluminum and its alloys. In this regard the modified triglycerides in addition to providing the desired lubrication and cooling also minimize "pick-up" on the working rolls, do not foam excessively or have an offensive and irritating odor and are capable of producing a bright stain-free sheet. These ester products have additional advantage if the aluminum is annealed.

The method of application of the lubricant will vary depending on the form of the lubircant being applied and the particular operation involved. In general, the modified triglycerides are applied using conventional methods such as spraying, wiping, brushing or rolling the lubricant on the surface of the metal or by passing the metal product through a bath containing the lubricant. When the mixed ester product is employed to prevent oxidation of the surface of the metal, application of the protective coating should be made at some stage in the process prior to exposure to conditions which promote oxidation.

The following examples, directed to the preparation of the above-described mixed ester lubricants and their utilization, illustrate the invention more fully. In these examples, all parts and percentages on a weight basis unless otherwise indicated.

EXAMPLE I

A glass reactor equipped with a stirrer, thermometer, nitrogen inlet and water-trap connected to a condenser was charged with 288 grams (1.0 equivalent) soybean oil, 60 grams (0.3 equivalent) polyethylene glycol (PEG) having an average molecular weight of 400 and 85.5 grams (0.3 equivalent) Empol 1014 dimer acid (95% $C_{36}$ dibasic acid). The weight percentages of the respective reactants, based on the total charge, was 66.4, 13.8 and 19.8. To dry the system the mixture was heated with agitation while pulling a vacuum before addition of the stannous oxalate catalyst (0.03 weight percent based on the total reactant charge). The reaction mixture was then heated to 200° C for about 9 hours while removing water of reaction. After cooling the reaction produce was filtered using 0.5% diatomaceous earth filtering aid. The modified triglyceride (acid value 16.9) exhibited good lubricity and was readily emulsifiable in cold tap water with moderate agitation. The resulting aqueous emulsions had good stability. The modified triglycerides also exhibited markedly improved thermal stability as compared to unmodified soybean oil. Thermal stability was determined by thermal gravimetric analysis (TGA) by heating the samples in a vacuum while increasing the temperture at a rate of 10° C/min. Unmodified soybean oil was 90% decomposed at 275° C whereas the modified triglyceride showed only 35% weight loss at 275° C and only after heating to 425° C was 90% weight loss obtained.

EXAMPLE II

A series of modified triglycerides were prepared from top white tallow and PEG 400 employing varying amounts of dimer acid. The procedure employed was similar to that described in Example I with the exception that tetrabutyltitanate was used as the catalyst. Composition of the various products (equivalents/-weight%) and other pertinent properties are set forth below.

| | SAMPLE NO. | | |
|---|---|---|---|
| | IIA | IIB | IIC |
| Tallow | 1.0/76.5 | 1.0/71.1 | 1.0/66.4 |
| PEG 400 | 0.3/15.9 | 0.3/14.8 | 0.3/13.8 |
| Empol 1018 Dimer Acid[1] | 0.1/7.6 | 0.2/14.1 | 0.3/19.8 |
| Acid Value | 5.2 | 8.5 | 13.6 |
| Hydroxyl Value | 36.2 | 24.3 | 19.1 |
| Smoke Point (° F)[2] | 370 | 380 | 380 |
| Flash Point (° F)[3] | 550 | 570 | 530 |

-continued

| | SAMPLE NO. | | |
|---|---|---|---|
| | IIA | IIB | IIC |
| Fire Point (° F)[3] | 600 | 620 | 590 |

[1]83% $C_{36}$ dibasic acid and 17% $C_{34}$ tribasic acid.
[2]First visible signs of smoke.
[3]ASTM D 92-66.

All of the above compositions were readily emulsifiable with water and exhibited enhanced thermal stability as compared to unmodified tallow.

EXAMPLE III

Following the above-described procedures soybean oil was modified with PEG 400 and Empol 1018 Dimer acid. Product IIIA was obtained by reacting one equivalent refined soybean oil (bleached prior to use), 0.3 PEG and 0.3 equivalent dimer acid. The resulting modified triglyceride had the following properties:

| | SAMPLE NO. | |
|---|---|---|
| | IIIA | IIIB |
| Acid Value | 8.1 | 16.3 |
| Hydroxyl Value | 42.3 | 19.7 |
| Viscosities (Centistokes)[1] | | |
| 100° F | 62.6 | 113 |
| 210° F | 12.1 | 19.5 |
| Flash Point (° F) | 540 | 570 |
| Fire Point (° F) | 650 | 610 |
| Thermal Stability | Excellent | Excellent |
| Emulsifiability in Water | Excellent | Excellent |

[1]ASTM D 445-65

EXAMPLE IV

Soybean oil (one equivalent) was modified by reacting therewith 0.3 equivalent PEG 400 and 0.3 equivalent 5(6)-carboxy-4-hexyl-2-cyclohexene-1-octanoic acid obtained by the Diels-Alder addition of acrylic acid and conjugated linoleic acid. The weight percentages of the respective reactants, based on total charge, were 71.4, 14.9 and 13.7. The reaction was conducted at 220° C for 8 to 10 hours using a titanate catalyst. The resulting product had an acid value of 26.0, was readily emulsifiable in cold water and was an effective lubricant.

EXAMPLE V

To demonstrate the versatility of a present invention and the ability to modify a variety of triglycerides to obtain useful lubricants, peanut oil, refined rapeseed oil and lard oil (Extra No. 1) were reacted as follows:

| | SAMPLE NO. | | |
|---|---|---|---|
| | VA | VB | VC |
| Peanut Oil (equivalents) | 1.0 | — | — |
| Rapeseed Oil (equivalents) | — | 1.0 | — |
| Lard Oil (equivalents) | — | — | 1.0 |
| PEG 400 (equivalents) | 0.3 | 0.3 | 0.3 |
| Empol 1018 Dimer Acid (equivalents) | 0.3 | 0.3 | 0.3 |
| Hydroxy Value | 1.31 | 16.8 | 9.6 |
| Acid Value | 12.4 | 16.2 | 16.6 |

Each of these products emulsified readily with water and exhibited excellent lubricating properties in neat form when combined with other base oils or emulsified in water.

EXAMPLE VI

To demonstrate the necessity of reacting the polyoxyalkylene glycol and high molecular weight dicarboxylic acid with triglyceride and the ability to obtain a variety of useful products by varying the reaction conditions the following experiment was conducted. A reaction mixture consisting of 66.4 wt. % soybean oil, 13.8 wt. % PEG 400 and 19.8 wt. % Empol 1018 dimer acid was heated at 220° C in the presence of 0.03 wt. % tetrabutyltitanate catalyst. Samples were taken from the reaction mixture initially and after 15, 30 and 360 minutes of reaction. The acid value of each of the products was determined and the product was then evaluated for emulsifiability and thermal stability. The results were as follows:

| | SAMPLE | | | |
|---|---|---|---|---|
| | Initial | 15 Min. | 30 Min. | 360 Min. |
| Acid Value | 38.8 | 31.3 | 26.9 | 13.6 |
| Ability to form emulsions with water | No | Very Slight | Excellent | Excellent |
| Temp. (° C) at which 50% weight loss occurred | 270 | 280 | 275 | 300 |
| Temp. (° C) at which 90% weight loss occurred | 280 | 320 | 415 | 425 |

The above results clearly show the improvement in emulsifiability and thermal stability as the PEG and dicarboxylic acid are reacted with the triglyceride.

EXAMPLE VII

The effectiveness of the modified triglycerides to function as metal working lubricants was demonstrated using a Falex machine. This machine provides a convenient and reliable means for determining the film strength or load-carrying properties of lubricants under extreme pressures and is used throughout the industry. The test was conducted on both the neat oils and aqueous emulsions in accordance with ASTM test procedure D 2670-67. In the test, a cup containing the lubricant (60 grams neat oil or 600 grams of the aqueous emulsion) is positioned so that the pin and block assembly is completely immersed in the sample. Testing is commenced with an initial load of 300 pounds and after 5 minutes the load is increased to 750 pounds and maintained 15 minutes. The difference between the readings taken at the beginning and the end of the 15 minute cycle is reported as the units wear. The load is then increased in 250 pound increments at 1 minute intervals until failure. Results obtained with the products of Example II and III were:

| | Neat Oil | | 5% Aqueous Emulsion | |
|---|---|---|---|---|
| Product | Units Wear | Failure | Units Wear | Failure |
| IIA | 0 | 1500 | 0 | 4250 |
| IIB | 2 | 1250 | 1 | 3500 |
| IIC | 1 | 1250 | 2 | 3750 |
| IIIA | 7 | 1250 | 0 | 3000 |
| IIIB | 1 | 1250 | 0 | 3000 |

EXAMPLE VIII

Using a procedure similar to that described in Example VII the modified triglyceride products were evaluated in the Falex machine using aluminum 5083 alloy V-blocks in place of the conventional steel V-blocks.

Tests were conducted using 5% aqueous emulsions of Product IIA, IIB, IIC and IIIA. For the test 60 mls of the aqueous emulsion was heated to 120° F and the jaw pressure adjusted to 100 pounds and maintained for 2 minutes. The pressure was then increased to 500 pounds and at 2 minute intervals thereafter further increased by 250 pounds. After 15 minutes (1500 pounds) the jaw pressure is automatically increased up to 4500 pounds or until failure occurs. The total units wear (the summation of the readings taken at 100,500, 750, 1000 1250, and 1500 lbs) and the load at failure are reported in the table. NF indicates the product did not fail up to the maximum load of 4500 pounds.

| Product | Units Wear | Failure |
|---|---|---|
| IIA | 101 | NF |
| IIB | 116 | 3700 |
| IIC | 113 | 3500 |
| IIIA | 109 | 3000 |

EXAMPLE IX

Additional tests were conducted following the procedure of Example VIII except that the metal working lubricants evaluated were 5% aqueous emulsions of a 50/50 mixture of 100 SUS mineral oil and the specified modified triglyceride. Test results were as follows:

| Product | Units Wear | Failure |
|---|---|---|
| IIA | 129 | 3600 |
| IIB | 63 | 3700 |
| IIC | 128 | 4000 |
| IIIA | 98 | 3500 |
| IIIB | 73 | 2750 |
| VA | 83 | 3450 |
| VB | 187 | 3550 |
| VC | 105 | 3550 |

EXAMPLE X

To demonstrate the non-staining character of the modified triglycerides the product was volatilized to determine the amount and type of residue remaining. Prior to use the aluminum weighing dishes (1¼ inch diam.) were heated 6–8 hours at 800° F to remove any residual oils. The dishes containing 0.1 ml sample (uniformly spread over the bottom) were then heated in a muffle furnace at 650° F for 30 minutes and visually inspected and rated for staining from 1 (no stain or very light tan stain) to 5 (heavy brownish/black stain). An average of at least four tests is reported as the stain rating. When a 5% aqueous emulsion of Product IIA was evaluated using this test procedure a stain rating of 1 was obtained.

EXAMPLE XI

5 Percent aqueous emulsions of 50/50 blends of 100 SUS mineral oil and modified triglycerides were prepared and evaluated for staining following the procedure of Example X. The following list gives the average stain rating obtained with the various aqueous metal working lubricating products.

| Product | Stain Rating |
|---|---|
| I | 1.0 |
| IIA | 1.4 |
| IIB | 1.5 |
| IIC | 1.3 |
| IV | 1.5 |

-continued

| Product | Stain Rating |
|---|---|
| VA | 1.3 |
| VB | 1.7 |
| VC | 1.3 |

EXAMPLE XII

A 50/50 blend of mineral oil and the modified triglyceride of IIIB was emulsified. One-tenth ml. of the 5% aqueous emulsion was applied on the surface of clean sheets of titanium, copper and magnesium metals. Metal sheets were then heated at 650° C for 30 minutes and inspected for staining. There was no visible stain on the titanium and only very slight staining of the copper and magnesium.

EXAMPLE XIII

In addition to their superior lubrication and non-staining characteristics, this example demonstrates that the products of this invention can also be used as protective oils for the prevention of water stains on the surface of aluminum and aluminum alloys. To determine the resistance of water staining 6 inch × 3 inch coupons cut from fresly rolled aluminum sheet (solvent washed to remove any residual rolling oil) were coated with 5% aqueous emulsions of a 50/50 blend of mineral oil and the modified triglyceride. Several drops of the aqueous lubricating oil were placed on one side of each previously weight sheet and uniformly spread with lint free tissue. After drying each sheet was reweighed and the film weight adjusted, if necessary, until 1– 1.5 mg. oil was present on the sheet. Each panel was then perpendicularly mounted ¾ – 1 inch in front of the side arm of a stoppered 500 ml. filtration flask containing about 300 mls vigorously boiling water. After five minutes steam exposure the coupon was removed, lightly wiped and visually examined for staining. Each coupon was then rated from 1 to 5 in accordance with the following scale.

NO — no visible stain
1 — less than ⅛ inch diameter visible stain
2 — ⅛ inch to ¼ diameter visible stain
3 — greater than ¼ inch to ½ inch diameter visible stain
4 — greater than ½ to ¾ diameter visible stain
5 — greater than ¾ diameter visible stain.

Results reported are the average obtained for duplicate samples.

| Product | Water Stain Rating |
|---|---|
| I | NS |
| IIA | 3 |
| IIB | 1 |
| IIC | NS |
| IIIA | 3 |
| IIIB | NS |
| IVA | NS |
| IVB | NS |
| IVC | NS |

A control panel which contained no protective oil had a water stain rating of 5+.

EXAMPLE XIV

A similar water stain test was conducted using copper and magnesium metals. The modified triglyceride used was the product of Example IIIB. Only very slight staining was visible on the treated metals whereas unprotected copper and magnesium showed moderate to heavy staining.

EXAMPLE XV

To demonstrate the versatility of the present invention and the ability to obtain useful products by alternative methods one equivalent Empol 1018 Dimer acid was esterified with 2 equivalents polyoxyethylene glycol having an average molecular weight of about 400. The reaction was conducted at about 200° - 220° C until the acid value was approximately 5. 205.8 Grams (0.3 equivalent) of the resulting ester product was then combined with 288 grams (1.0 equivalent) refined soybean oil and 0.03 wt. % tetrabutyltitanate catalyst. This mixture was then reacted for about 5 hours. The resulting product was readily emulsifiable with water and had excellent lubrication properties. The neat oil showed only two units wear in the ASTM D 2670-67 Falex Test with failure occurring at 1250 pounds. A 5% aqueous emulsion of a 50/50 blend of this product and mineral oil gave nine units wear and did not fail up to the maximum load of 4500 pounds.

EXAMPLE XVI

Blends were prepared with mineral oil and the final modified triglyceride product (acid value 13.6) obtained from Example VI. Aqueous emulsions of these products were prepared and evaluated for their lubricating properties in accordance with the test procedure of Example VIII. The composition of the blends, the concentration of the aqueous emulsion tested and the test results obtained in the Falex test are as follows:

| | | | | |
|---|---|---|---|---|
| Mineral oil/modified triglyceride | 25/75 | 75/25 | 50/50 | 50/50 |
| % Blend in water | 5 | 5 | 5 | 5 |
| Falex properties: | | | | |
| Units Wear | 65 | 158 | 103 | 81 |
| Failure | 3100 | 2350 | 3450 | 3650 |

All of the above blends were essentialy non-staining to aluminum and aluminum alloys and were effective protective oils for the prevention of water staining of the metal stock.

EXAMPLE XVII

A useful metal working lubricant was prepared by reacting 0.3 equivalent polyethylene glycol having an average molecular weight of about 1000, 0.3 equivalent $C_{36}$ dibasic acid and 1.0 equivalent refined soybean oil. The reaction was conducted for 5 hours at 210° C until an acid value of 21.9 was achieved. The modified triglyceride which was a semi-solid at room temperature had 100° F and 210° F viscosities of 154.1 and 23.9 centistokes, respectively. In the Falex test the neat oil gave only 2 units wear. A 5% emulsion of the mixed ester product showed only 5 units wear and did not fail up to the maximum load of 4500 pounds.

EXAMPLE XVIII

A modified triglyceride containing 73.1 wt. % soybean oil, 21.8 wt. % dimer acid and 5.1 wt. % PEG 400 was prepared by transesterifying the components at 200°-220° C for 3 hours until an acid value of 34.8 was reached. The catalyst for this reaction was 0.3% dibutyltindiacetate. The product was emulsifiable in water, however, to enhance the emulsion stability a small amount of ethoxylated (6 E.O.) tridecyl alcohol was used in the preparation of several aqueous metal working fluids. Both the neat oil and 5% aqueous emulsions thereof were essentially non-staining to aluminum and in the steam test consistently gave water stain ratings less than 1. An aqueous emulsion (5% modified triglyceride and 0.0005% emulsifier) evaluated following the test procedure of Example VIII gave only 76 units wear and had not yet failed at 4500 pounds load, the upper load limit of the machine.

I claim:

1. An aluminum or aluminum alloy product essentially free of surface stain and resistant to subsequent water stain having applied on the surface thereof a protective coating of a modified triglyceride obtained by transesterifying until the acid value is reduced by at least 25%, 50–84 parts triglyceride derived predominantly from $C_{12}$–$C_{18}$ fatty acids, 2–36 parts polyoxyethylene glycol having an average molecular weight from about 200 to 1500 and 7–48 parts of an aliphatic or cycloaliphatic dicarboxylic acid containing 18 to 54 carbon atoms.

2. The aluminum or aluminum alloy product of claim 1 wherein the triglyceride is selected from the group consisting of lard, tallow, soybean oil, coconut oil, castor oil, rapeseed oil, peanut oil, or crambe oil, the polyoxyethylene glycol has an average molecular weight between about 400 and 1000 and the dicarboxylic acid is a dimer acid obtained by the dimerization of unsaturated $C_{18}$ fatty acids.

3. The aluminum or aluminum alloy product of claim 2 wherein the modified triglyceride is obtained by the transesterification of 60–76 parts triglyceride, 4–20 parts polyoxyethylene glycol and 14–36 parts dimer acid containing at least 75% by weight $C_{36}$ dicarboxylic acid.

4. The aluminum or aluminum alloy product of claim 3 wherein the protective coating is applied from an aqueous emulsion or dispersion of the modified triglyceride.

5. The aluminum or aluminum alloy product of claim 3 wherein the protective coating is applied from a solution of the modified triglyceride and a mineral oil or mineral seal oil.

* * * * *